United States Patent [19]

Yano

[11] Patent Number: 4,734,734

[45] Date of Patent: Mar. 29, 1988

[54] IMAGE FORMING APPARATUS AND ERASURE ILLUMINATION DEVICE THEREFOR

[75] Inventor: Hideaki Yano, Kokubunji, Japan

[73] Assignee: Canon Kabushiki Kaisha, Tokyo, Japan

[21] Appl. No.: 823,290

[22] Filed: Jan. 28, 1986

[30] Foreign Application Priority Data

Feb. 1, 1985 [JP] Japan ..... 60-018094
Feb. 1, 1985 [JP] Japan ..... 60-018095
Feb. 1, 1985 [JP] Japan ..... 60-018096

[51] Int. Cl.[4] ..... G03G 15/00; G03G 15/04

[52] U.S. Cl. ..... 355/3 R; 355/7; 355/14 E; 346/107 R

[58] Field of Search ..... 355/3 R, 1, 7, 14 E, 355/67, 68, 69, 70; 346/107 R

[56] References Cited

U.S. PATENT DOCUMENTS

| | | | |
|---|---|---|---|
| 4,255,042 | 3/1981 | Armitage, Jr. et al. | 355/3 R |
| 4,272,183 | 9/1981 | Maese et al. | 355/15 X |
| 4,344,691 | 8/1982 | Grant et al. | 355/1 |
| 4,435,064 | 3/1984 | Tsukada et al. | 355/3 R X |
| 4,490,032 | 12/1984 | Conly et al. | 358/300 X |
| 4,552,447 | 11/1985 | Sagara et al. | 355/3 R |
| 4,576,464 | 3/1986 | Sakata et al. | 355/3 R |
| 4,582,417 | 4/1986 | Yagasaki et al. | 355/7 |
| 4,585,330 | 4/1986 | Yamamoto et al. | 355/3 R |
| 4,590,492 | 5/1986 | Meier | 355/1 X |

*Primary Examiner*—Arthur T. Grimley
*Assistant Examiner*—J. Pendegrass
*Attorney, Agent, or Firm*—Fitzpatrick, Cella, Harper & Scinto

[57] ABSTRACT

An image forming apparatus includes a movable image bearing member; a charger for electrically charging the image bearing member; developing device for developing an electrostatic latent image formed on the image bearing member; illumination device disposed between the charger and the developing device, for illuminating the image bearing member to remove the electric charge from the image bearing member to prevent deposition of a developer by the developing device in an area exposed to the illumination thereof, the illumination device including a plurality of LED elements arranged substantially along a line extending in a direction crossing with a direction of movement of the image bearing member and light blocking element provided correspondingly to each of the LED elements and having substantially rectangular apertures each of which allows light from the associated LED element to pass to the image bearing member to illuminate it with a substantially rectangular illumination area; and controller for controlling actuation of each of the LED elements. Thus, a non-image area can be changed, and the boundary between the non-image area and an adjacent image area is sharp because the illumination area provided is in a rectangular form.

27 Claims, 19 Drawing Figures

IMAGE FORMING APPARATUS AND ERASURE ILLUMINATION DEVICE THEREFOR

FIELD OF THE INVENTION AND RELATED ART

The present invention relates to an image forming apparatus, and more particularly to an erasure illumination device therefor by which a non-image area is irradiated so as to prevent a developer from depositing an image bearing member in that area.

In an image forming apparatus wherein a developed image formed on an image bearing member is transferred onto a transfer material and then fixed, a variable magnification type is widely used, in which a various sizes of copy images can be provided from the same original. Additionally, there is an increasing demand for an image forming apparatus having a compiling function, such as masking and trimming functions wherein a desired area of an original is erased and another original is inserted in place thereof.

In this type of image forming apparatus, there is an area to be subjected to image formation and development, which will hereinafter be called the "image area" and there is another area. The latter area includes an area outside the dimensions of an original, an area within the dimensions of the original which is predetermined as not being subjected to the image forming operation, an area within the original image which is not subjected to the image forming operation irrespective of whether or not an image is present, and an area (when a first image and a second image is combined) including a second image area other than a first image at the time when the first image is to be formed; those areas will hereinafter be called the "non-image area".

Since the non-image area of an image bearing member is not exposed to light upon an image exposure so that the electric charge thereon given by a sensitizing operation is retained thereon, the toner particles are deposited on the non-image area at the subsequent image developing operation. This wastes the toner, and in addition, increases the load of the cleaning means, and leads to contamination within the apparatus. In order to prevent this, it is usual to illuminate the non-image area so as to remove the electric charge on the non-image area before development.

An illumination device for removing the electric charge, (which is not necessary for the image area of the image bearing member) is shown in FIG. 1 to comprise a proper number of light emitting elements such as LED (Light Emitting Diode) elements 32 disposed opposed to a surface of an image bearing member 31 and turned on or off as desired so as to remove the electric charge from the non-image are Y. Each of the LED elements 32 comprises, for example, a transparent cylindrical part 33 and a light condensing part 34 in the form of a convex lens at an end opposed to a member to be illuminated.

In this case however, the light emitted from the condensing part 34 of the LED element 32 can effectively remove the electric charge, but a part of the light rays emitted through the cylindrical part 33 (particularly the rays 35 as shown in FIG. 1) reach the image area X, with the result that the boundary between the image area X and the non-image area Y is not sharp so as to deteriorate the image quality.

In more detail, as shown in FIG. 1, a part of the light rays emitted from the LED elements 32 invades the boundary 36 on the image bearing member 31 extending along the direction of its rotation. Additionally, the light rays from the LED elements 32 illuminate a circular region on the image bearing member 31, which results in an unsharp waveform boundary between the non-image area Y and the image area X in the region 37 adjacent the boundary extending in the longitudinal direction of the image bearing member 31. When the compilation is performed with this structure, the same condition occurs in the boundary of the discharge area Z within the image area X.

Therefore, in the neighborhood of the boundary between the image area and the non-image area or the area from which the image is to be erased, the image quality is degraded, such a boundary being important in the case of varied magnification and compiling operations.

SUMMARY OF THE INVENTION

Accordingly, it is a principal object of the present invention to provide an image forming apparatus and an erasure illumination device therefor in which the region to which an erasing light is supplied can be changed in accordance with the variation of the non-image area.

It is another object of the present invention to provide an image forming apparatus and an erasure illumination device therefore in which the boundary between the image area and the non-image area is made sharp at all times irrespective of the variation in the non-image area.

It is a further object of the present invention to provide an image forming apparatus and an erasure illumination device therefor in which a high image quality in the neighborehood of the boundary between the image area and the non-image area is maintained, thus providing a high quality image.

It is a further object of the present invention to provide an image forming apparatus and an erasure illumination device therefor, in which the boundary between the illuminated area and non-illuminated area is sharp.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
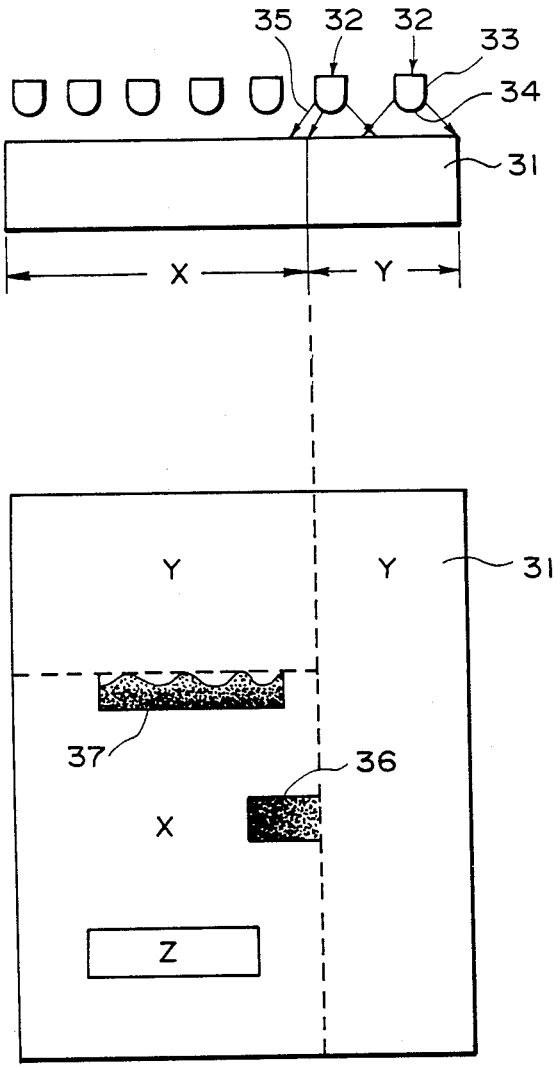
FIG. 1 illustrates an embodiment of an erasure illumination device.

Preferred embodiments of the present invention will be described in conjunction with the accompanying drawings wherein the elements having a similar function are assigned the same reference numerals.

Figure 2:
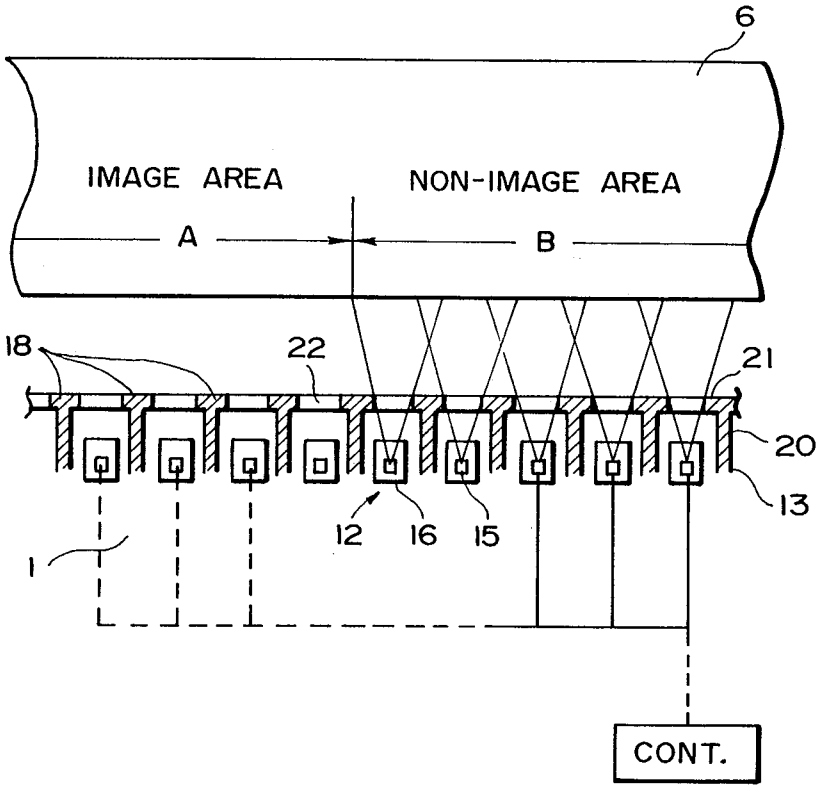
FIG. 2 is a sectional view of an illumination device according to an embodiment of the present invention.

Referring now to FIG. 2, there is shown an illumination device according to an embodiment of the present invention, in which the illumination device 1 extends opposing the surface of the image bearing member 6 along its entire length. The illumination device 1 includes light emitting elements 12 and light blocking means 18. Each of the light emitting elements 12 is, in this embodiment, an LED (Light Emitting Diode) element which comprises a light emitting chip 15 embedded in a mold 16 of a synthetic resin. Since the size of the LED element is very small, therefore, it is very effective in changing the illumination area in small increments. In this embodiment, the LED elements 12 are arranged at regular intervals along a rectilinear line extending in a direction substantially perpendicular to the direction of the image bearing member movement so as to constitute an array (not shown) of the LED elements. Correspondingly, the light blocking parts 13 constitute an array so that one LED element 12 corresponds to one light blocking part, and those parts constitute a light blocking means as a whole.

The light blocking means 18 includes the light blocking parts 13 arranged rectilinearly and as a unit in the form of a frame which is made of a synthetic resin or the like and which is black in color so as to block the light. Each of the light blocking parts 13 includes a lateral wall 20 and an inside flange 21 which constitutes an end aperture 22 which is rectangular. The inside flange 21 is not always necessary, but it will suffice if the rectangular aperture is formed in the end. The light blocking means 18 accommodates the LED elements 12 at the respective predetermined positions within the corresponding light blocking parts 13, and is securely fixed on a substrate (not shown) of the LED array.

The LED elements 12 are controlled by control means of an image forming apparatus so that the LED elements corresponding to the image area A are not turned on, while the LED elements 12 corresponding to the non-image area B are turned on. The light blocking means 18 has a rectangular apertures 22 which are associated with the LED elements, respectively. The light emitted from the LED elements is formed so as to have a rectangular cross-section by the aperture 22, and then reach the surface of the image bearing member.

By applying only the effective light rays limited by the light blocking means onto the non-image area, the boundary between the image area A and the non-image area B can be made sharp, so that the desired image adjacent the boundary is not influenced.

Since the light has a rectangular cross-section, that is, the light is limited in four directions, the boundary can be made in the four directions on an image transfer material.

Additionally, since a plurality of small sized LED elements are used as the light source means, it can produce fine variations in the position of the non-image and the image areas.

In this embodiment, the rectangular illumination areas formed through adjacent apertures 22 are partly superimposed in the neighborhood of the adjacent ends. This is effective to increase the light quantity in the middle between the adjacent LED elements 12, resulting in a further desirable charge removing effect.

Figure 10:
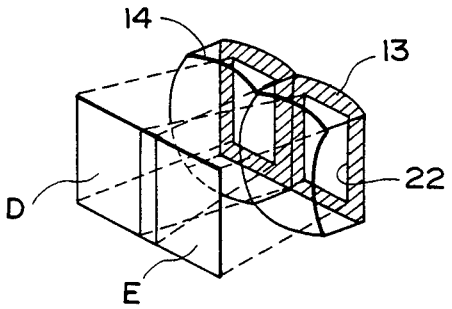
FIG. 10 is a perspective view illustrating the illumination according to an embodiment of the present invention.

Since the illumination areas D and E provided by the adjacent LED elements 12 are linearly continuous as in an embodiment of FIG. 10 which will be described hereinafter, the boundary between the image area and the non-image area can be made rectilinear without unsmoothness.

The direction in which the LED array extends may be any direction crossing or non-parallel with the direction of the image bearing member movement. However, it is desirably substantially perpendicular to the direction of movement of the image bearing member, since when this is the case the rectilinearity of the boundary between the image area and the non-image area can be easily provided, and the LED elements can be easily controlled.

Figure 3:
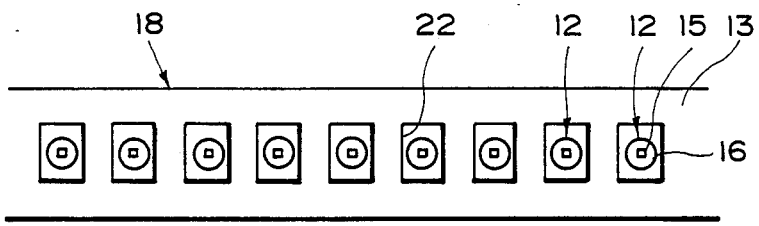
FIG. 3 is a plan view of the illumination device of FIG. 2.

FIG. 3 is a plan view from the top, of the illumination device 1, wherein it is best seen that the aperture 22 is rectangular.

Figure 4:
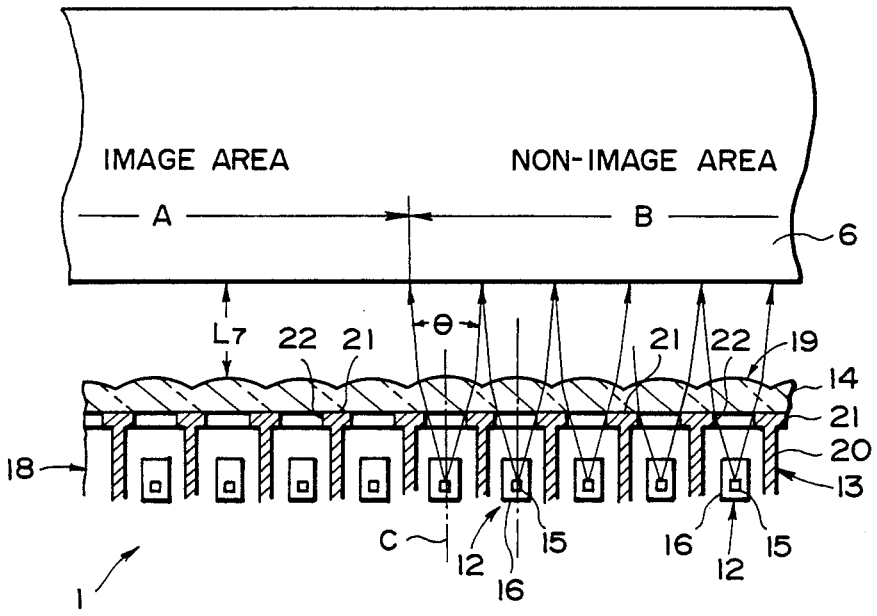
FIG. 4 is a sectional view of another embodiment of the present invention.

FIG. 4 illustrates another embodiment of the present invention, wherein each of the apertures 22 of the light blocking means 18 is provided with a lens means 14. The lens means 14 is effective to condense the light through the aperture 22 to the image bearing member 6, and therefore, to decrease the divergent angle $\theta$ of the light rays. Because of this, the intensity of the light incident on the image bearing member 6 is increased, and the distance $L_7$ between the illumination device and the image bearing member 6 can be increased, whereby the possible decrease in the quantity of light illuminating member 6 can be prevented, (this possible decrease being caused by developer particles and dust which floats around the image bearing member 6 being deposited on the illumination device).

Figure 5:
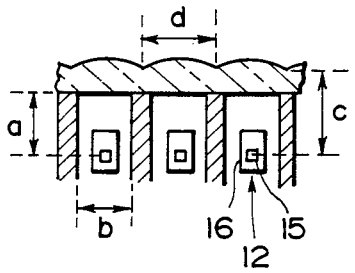
FIG. 5 illustrates an embodiment of the present invention.

FIG. 5 illustrates the relationship between the dimensions of the device. In this Figure, the illumination device 1 is shown as not having an inside flange, but the aperture 22 is similarly in a rectangular form.

The distance a from a light emitting chip of the LED element and the aperture 22, a length b of a diagonal line of the rectangular aperture 22, a distance c from the light emitting chip of the LED elements to the lens means 14, and a maximum diameter d of the lens means 14 desirably satisfy:

$$d \geqq bc/a$$

When this equation is satisfied, the light from a light emitting chip is not incident to an unassociated lens, more particularly, the adjacent lenses. In other words, the light from a light emitting chip is incident only on the corresponding lens means 14, when there is no light reflected by the light blocking part 13. Therefore, the boundary between the image area and the non-image area can be made sharper, which is desirable.

Figure 6:
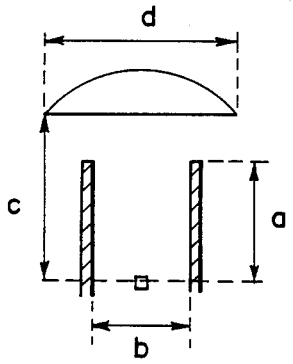
FIG. 6 illustrates an illumination device according to a further embodiment of the present invention.

FIG. 6 illustrates a further embodiment in which the lens means 14 and the light blocking means do not contact each other. From the viewpoint of increasing the distance from the image bearing member 6, it is desirable that these two elements contact each other, but it is not absolutely necessary, and they can be spaced apart from each other. In this case, it is also preferable that $d \geqq bc/a$ is satisfied.

Figure 7:
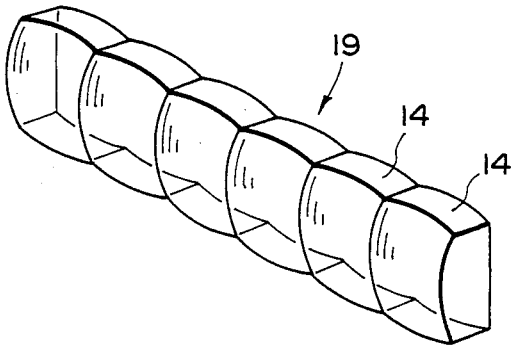
FIG. 7 is a perspective illustrating an example of a lens array.

FIG. 7 is a perspective view of the lens means 14 used with the embodiment of FIG. 4, which constitute as a whole a lens array 19. The lens array 19 is constituted by the lens means 14 arranged rectilinearly as a unit, the lens means 14 being convex lenses of acrylic resin or glass or the like. The lens array 19 is disposed in front of the light blocking means 18 so that the optical axis C of each of the lens means 14 extends through the center of the aperture 22 of the light blocking means 18. The light emitting chip 15 of the LED element 12 is positioned on the optical axis C.

The lens means 14 are effective to increase the intensity of light incident on the image bearing member 6 as described hereinbefore and are also effective to allow the distance $L_7$ from the illumination device to be increased.

Figure 8:
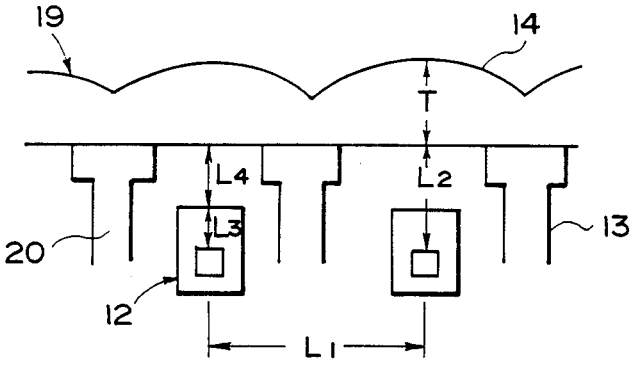
FIG. 8 is a sectional view indicating dimensions of parts of the device.
Figure 9:
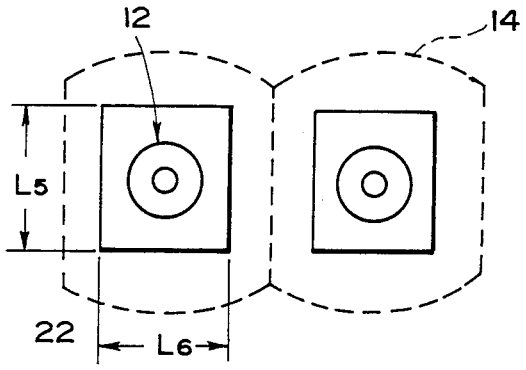
FIG. 9 is a plan view of the device shown in FIG. 8.

FIGS. 8 and 9 show an example of the dimensions of the various parts when an acrylic lens having a refraction index of 1.5 and an LED element emitting the light having the wavelength of 610 nm are used. The interval $L_1$ between adjacent LED elements is 2.5 mm; the optical path length $L_2$ from the light emitting chip 15 of the LED element 12 to the lens means 14 is 2.0 mm, the mold (16) part length $L_3$ is 1.5 mm, and air part length $L_4$ is 1.0 mm; the longitudinal length of the aperture 22 is 1.6 mm; the lateral length thereof $L_6$ is 1.4 mm; the radius R of curvature of the lens means 14 is 2.3 mm; the thickness T is 1.4 mm; and the interval $L_7$ between the lens means 14 and the image bearing member 6 is 2.0–3.0 mm. The surface of the image bearing member 6 is illuminated by the illumination device of the present invention comprising lens means 14 in the following manner. The light emitted from the light emitting chip 15 of the LED element 12 is blocked by the light blocking member 13 and is allowed to pass only through the aperture 22 thereby producing light having a rectangular cross-section. The angle of divergence of the illumination light rays is limited and small due to lens means 14, and the light is thrown on the image bearing member 6 in rectangular form. Since a lateral wall 20 of the light blocking member 13 is positioned between the adjacent LED elements 12, the light from one LED element 12 does not leak through to the adjacent LED, so that the light from one LED is not incident on the lens means 14 associated with the adjacent LED element 12.

Figure 11:
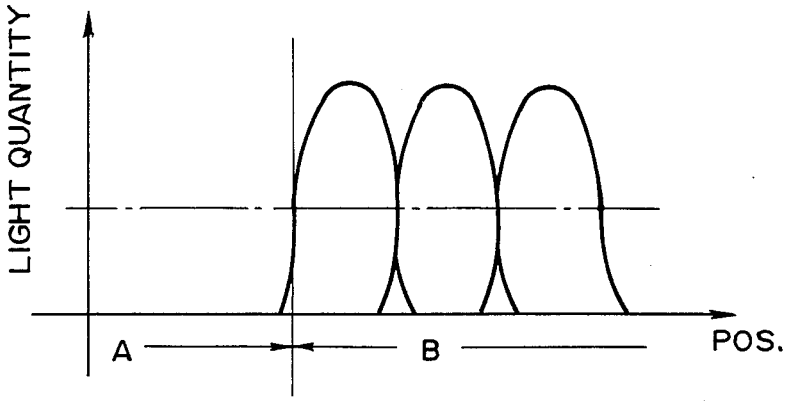
FIG. 11 is a graph illustrating the distribution of the quantity of light of the illumination device of FIG. 10.

In this manner,the light rays from the LED element 12 are reformed into a rectangular shape by the light blocking means 13, and simultaneously, the lens means 14 is effective to maintain a small angle $\theta$ of divergence so as to provide a high intensity rectangular illumination area on the image bearing member 6. The other light does not reach the image bearing member 6. Therefore, the surface of the image bearing member 6 is illuminated by the rectangular illumination area which is proportional to the aperture 22 of the light blocking means 13, and the light does not reach the area outside of the rectangular area. Accordingly, by determining the positions and the shapes of the LED elements 12, the light blocking means 13 and the lens means 14 so that the adjacent illumination areas D and E contact each other without clearance as shown in FIG. 10, the distribution of the quantity of light received by the image bearing member 6 is such that, as shown in FIG. 11, the light does not leak to the image area A, while the non-image area B is illuminated sharply with a high light intensity. The low light intensity part of the light quantity distribution is higher than the level necessary for discharging the image bearing member 6 so that the non-image area B is uniformly discharged. It is preferable that the above mentioned positions and shapes are determined so that a marginal part of the illumination area is superimposed on a marginal area of the adjacent illumination area so as to increase the light intensity in the middle area between the adjacent illumination areas. The light intensity in the middle area can be controlled by changing the degree of superimposition. As described hereinbefore, the illumination areas D and E can be made continuous rectilinearly, so that the boundary can be made to be a sharp rectilinear line.

In the embodiment shown, the lens means 14 has been described as a lens array 19 having the lens means arranged rectilinearly. This is advantageous in that the lens means 14 as a whole can be manufactured easily with the number of lens elements located with high precision. When the lens elements are manufactured separately and then disposed with respect to the respective LED elements, the position of the lens elements may deviate from the positions which they should be in. If this occurs, the light from the LED elements 12 arranged in a line is not straight because the light rays from the LED elements 12 deviate from the direction perpendicular to the direction of the array, with the result that the surface of the image bearing member 6 can not be illuminated along a rectilinear line in the direction of the rotational axis thereof. This does not occur when a unit lens element array 19 is used. Additionally, in this case, black partitions may be provided between the lens means 14 is necessary by a two-color formation method, which is advantageous in that the possibility of the light from one LED element 12 being incident on the adjacent lens means 14 can be prevented with further certainty.

The precision of the positions of the LED elements 12 may be enhanced by directly bonding them on the print substrate.

In the foregoing embodiments, the description has been made with respect to the case where the non-image area B is present only at one side of the image area A on the image bearing member 6 surface, but the non-image areas may be present at both sides of the image area A.

Figure 12:
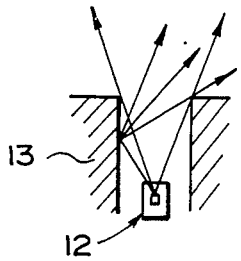
FIG. 12 is a sectional view illustrating the reflection of the light blocking means.

FIGS. 12–15 illustrate another embodiment. In this embodiment the light blocking means is formed by a material having a light reflecting property such as those having white color, and, as a result, the light emitted from the LED elements 12 is partly scatteredly reflected or specularly reflected by the inside surface of the light blocking means 13 as shown in FIG. 12. The flare light can reach the image area so as to make the boundary between the image area and the non-image area less sharp.

Figure 13:
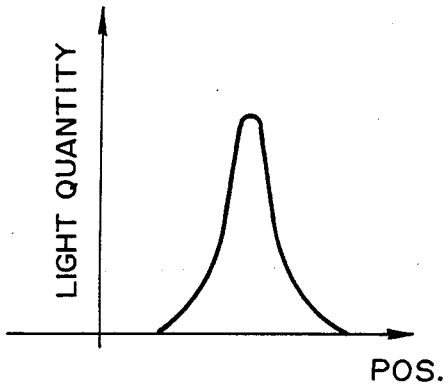
FIG. 13 is a graph illustrating the distribution of the light quantity in the device shown in FIG. 10.

FIG. 13 shows the distribution of the quantity of light in this case. Because of this flare light, the distribution is not sharp, and the illumination area on the image bearing member 6 is not a sharp rectangular form.

Figure 14:
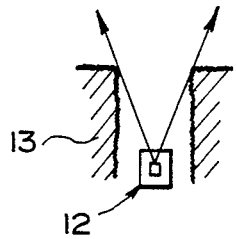
FIG. 14 is a sectional view of a further embodiment according to the present invention.
Figure 15:
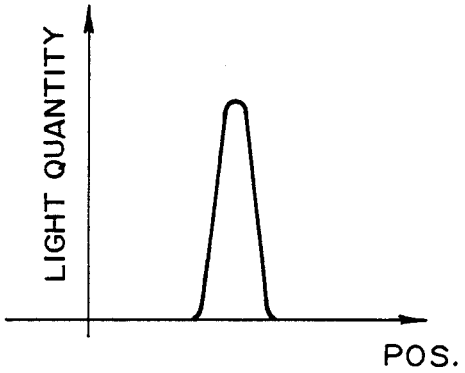
FIG. 15 illustrates the distribution of the quantity of light in the device shown in FIG. 14.

In FIG. 14, the light blocking member is made of a black material, and the surface is roughened so as to prevent the scattered reflection or specular reflection. With this embodiment, the boundary is made sharp, and a sharp rectangular illumination area is provided. Thus, by the anti-reflection treatment (black material and roughened surface), a sharp rectangular illumination area can be provided on the image bearing member.

Additionally, that surface of the light blocking means 18 which is opposed to the image bearing member 6 may be similarly provided with the anti-reflection surface, whereby secondary reflected light can be prevented, which is the light reflected by the surface of the image bearing member 6 and then reflected again by the light blocking means 13.

Figure 16:
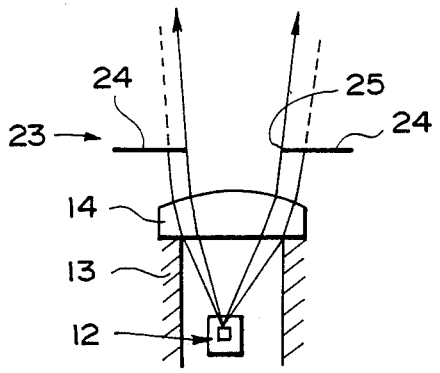
FIG. 16 is a sectional view of an illumination device according to a further embodiment of the present invention.
Figure 17:
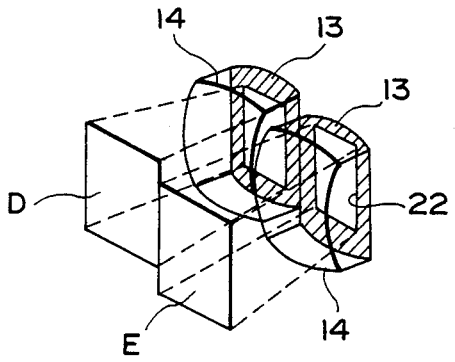
FIG. 17 is a perspective view illustrating the variation of the light illumination depending on the arrangement of the illumination device.

FIG. 16 illustrates a further embodiment. The illumination device according to this embodiment includes, in addiiton to the elements of the FIG. 4 embodiment, a slit member 23 between the lens means 14 and the image bearing member 6. The slit member 23 comprises a pair of plates 24 and 24 which are parallel with the image bearing member 6 at a side of a lens array 19 opposing the image bearing member 6. The surfaces of the plates 24 and 24 are black or the like in color so as to prevent light reflection. Between those plates 24 and 24, a slot 25 having rectilinear parallel edges is formed in a strip extending along the array of the LED elements 12. The slit member 23 is blocked in the rectangular form by the light blocking member 13. The illumination light limited through the lens means 14 is further transmitted through the slot 25 so that even in the case that a number of LED elements 12 are arranged rectilinearly, a strip of illumination area having rectilinear lateral edges extending along the array of the LED elements 12 is produced. When a number of LED elements 12 are disposed rectilinearly, and when the positions of the LED elements 12 deviate in the direction perpendicular to the direction of the array, as show in FIG. 17, the illumination areas D and E provided by the LED elements 12 deviate in that direction, with the result that an edge of the area which is electrically discharged by the illumiantion light, is not rectilinear. The slit member 23 is effective to block the deviated part of the light, so that the illumination area has the parallel rectilinear lateral edges along the array of the LED elements 12 through the slot 25. This effect is more pronounced when the slit member 23 is disposed in the neightborhood of the image bearing member 6.

If the shape of the slot 25 of the slit member 23 is rectangular, the illumination area on the image bearing member 6 is made rectangular with further certainty.

As described, according to the present invention, the image bearing member 6 may be exposed to an erasing illumination light having a rectangular cross-section. However, even with the anti-reflection treatment, the illumination area on the image bearing member 6 is not always rectangular due to a slight amount of flare light and because of the fact that the illumination area is slightly distorted due to the light being transmitted through a convex lens. However, the illumination area is substantially rectilinear so as not to adversely affect the image formation. When the lens means 14 is used, the shape of the aperture 22 of the light blocking means 18 may preferably be deformed so as to compensate the distortion by the lens, that is, the shape of the aperture 22 is such as to provide an exactly rectangular illumination area on the image bearing member 6 under the existence of the distortion by the lens.

FIG. 14 illustrates such an image forming apparatus 2 employing the illumination device 1 according to the present invention.

The image forming apparatus is capable of copying an original 3. The image forming apparatus 2 comprises an original illuminating lamp for illuminating the original 3 to be copied, an imaging optical system 5 including a plurality of optical elements such as a mirror and a lens or the like. The image forming apparatus 2 further comprises an image bearing member 6 in the form of a cylindrical member rotatable in the direction of an arrow, a. Around the image bearing member 6, there are provided a primary charger 7, a developing device 8, a transfer charger 9 and a cleaning device 10. The illumination device 1 according to the present invention is in the neighborhood of the surface of the image bearing member 6 between the primary charger 7 and the developer 8. There are additionally image fixing means and other necessary elements in the image forming apparatus, but the description of them is omitted for the sake of simplicity of explanation. The developed image provided by the developing device 8 on the image bearing member 6 is transferred onto a transfer material 11.

In the operation of the image forming apparatus 2, the image bearing member 6 surface is uniformly charged by the primary charger 7 and then is exposed through the imaging optical system 5 to an image light of the original 3, so that an electrostatic latent image is formed on the image bearing member 6, which is then developed or visualized by the developing device 8. The visualized image on the image bearing member 6 is transferred onto the transfer material 11 by the transfer charger 9. The transfer material 11 is then transported to an image fixing device where the image is fixed on the transfer material 11.

The image forming apparatus 2 in this embodiment has a variable magnification function by which the position of a lens of the imaging optical system 5 is changed so that the size of the copy can be changed. The magnification change may be stepwise or continuous.

In this case, as shown in FIG. 4, the non-image area B is present adjacent to the image area A in the effective imaging area (width) of the image bearing member 6. In the variable magnification image forming apparatus, the image area and the non-image area change in accordance with the magnification variation. A sharp boundary between the image area and the non-image area is desirable. Particularly when the magnification change is continuous, that is, the so-called zooming type apparatus, the boundary between the image area and the non-image area must be changed in fine increments, and in addition the boundary should preferably be sharp. The illumination device of the present invention is very effective in satisfying these requirements.

Figure 19:
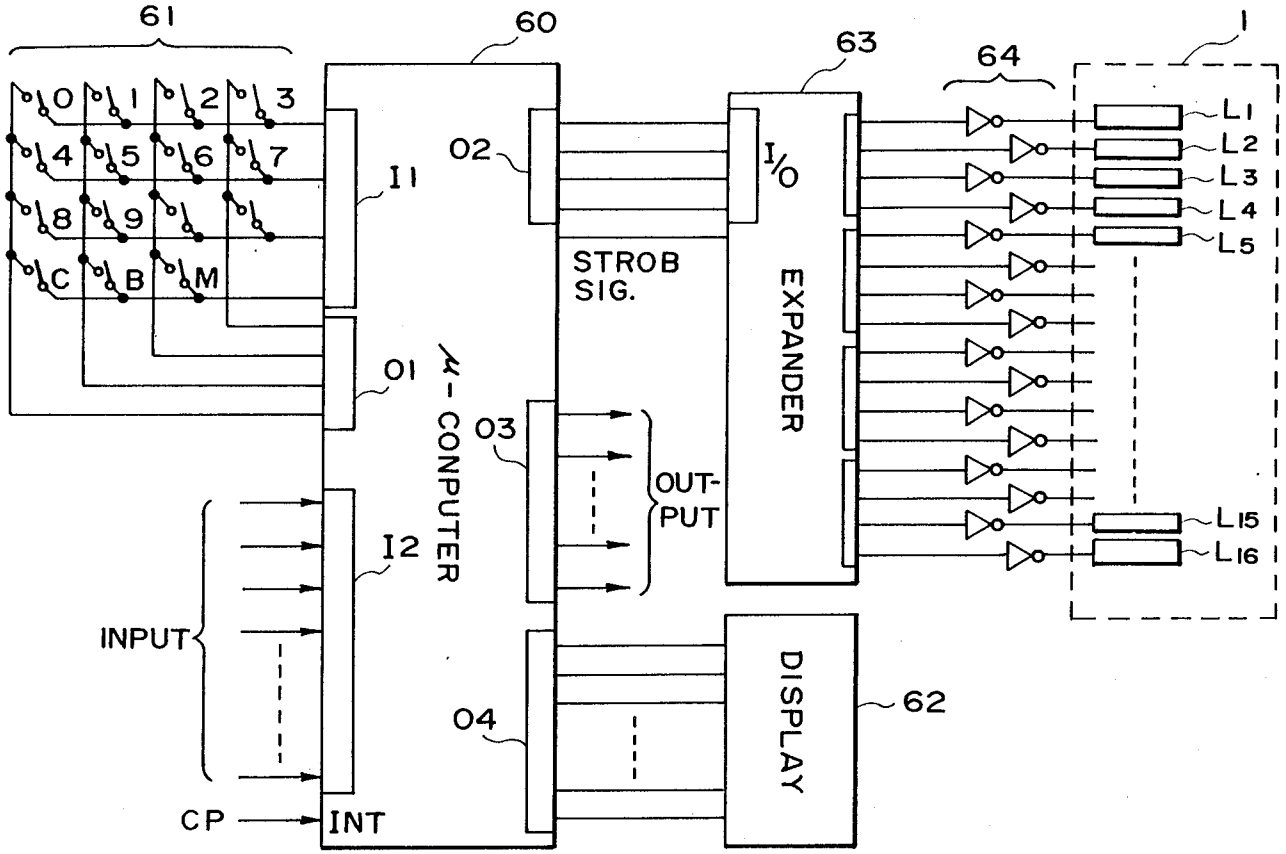
FIG. 19 is a block diagram illustrating the control of the image forming apparatus of FIG. 19.

FIG. 19 is a block diagram for illustrating the control of an image forming apparatus containing the illumination device according to the present invention and having a compiling function. The control means includes one-chip microcomputer 60 which is provided with an interruption port to which predetermined pulse signals CP are inputted from a well-known pulse generator.

Figure 18:
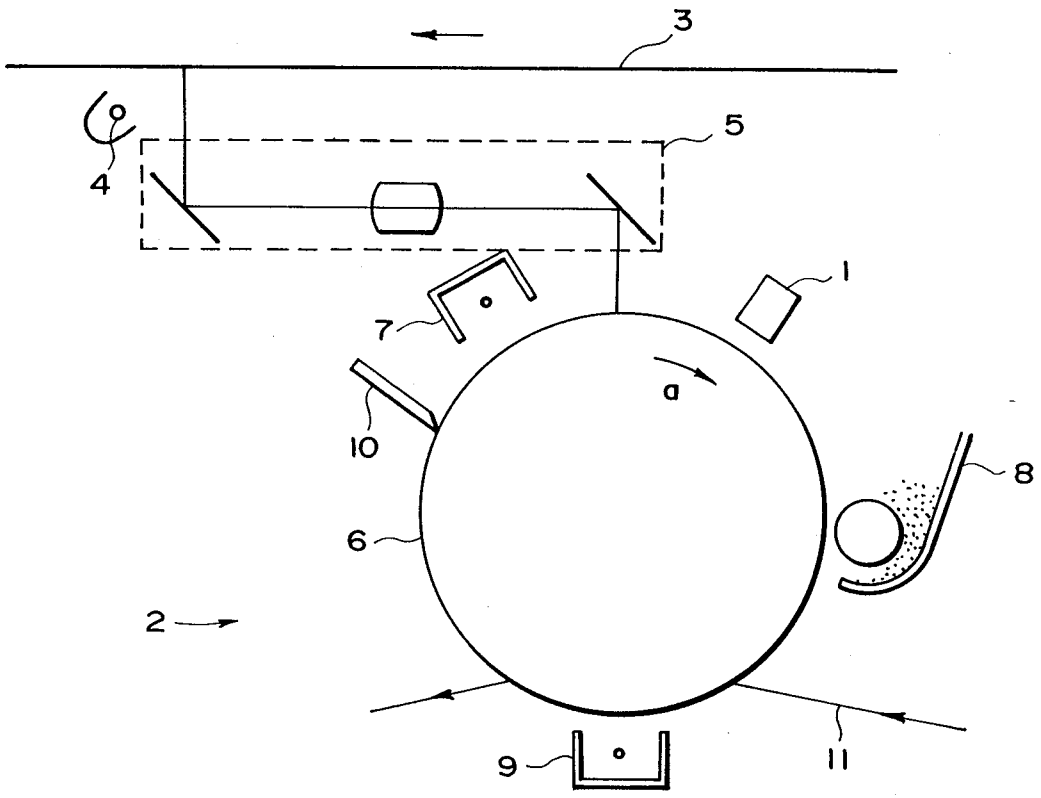
FIG. 18 is a schematic sectional view of an image forming apparatus according to an embodiment of the present invention.

The pulse signals CP is a reference of the operation of the microcomptuer 60. Keys 61 on the operating panel are effective to select regions of masking and trimming. The microcomputer 60 reads by the input port I1 the time-shared repeated pulses produced at the outlet port O1 so as to discriminate conditions of operation of the keys 61. The input port $I_2$ receives signals from sensors or the like of various parts of the apparatus. A display 62 is provided on the operating panel of FIG. 18 and is controlled by the signals produced at the outlet port O4 of the microcomputer. The outlet port O3 produces operation instructions at various parts of the apparatus. Sixteen LED elements L1–L16 are on-off conrolled through the inverter 64 in accordance with outputs of the I/O expander 63. More particularly, when the output of the I/O expander output is 1, the LED element is deenergized, when the output is O, the LED element is energized.

By this controlling mechanism, the LED elements L1–L16 can be controlled in accordance with the masking or trimming region designated on the operation panel 61.

When performing the compiling function such as the masking or the trimming, it is desired and preferable that the designation area be changed in fine increments, that the boundary between the image area and the non-image area be sharp, and/or that the illumination area on the image bearing member be rectilinear with sharp edges corresponding to the front, rear, left and right sides of the transfer paper. Since the illumination device 1 and the image forming apparatus 2 according to the embodiments of the present invention meet these requirements, the present invention is particularly advantageous in the case of the image forming apparatus having a compiling function such as masking and trimming.

In the embodiment described above having the lens means, the light emitting elements, the light blocking means and the lens means may be formed as a unit.

While the invention has been described with reference to the structures disclosed herein, it is not confined to the details set forth and this application is intended to cover such modifications or changes as may come within the purposes of the improvements or the scope of the following claims.

What is claimed is:

1. An illumination device for illuminating an image bearing member, comprising:

a plurality of LED elements arranged substantially along a line extending in use in a direction crossing with a direction of movement of the image bearing member;

light blocking means provided for and corresponding to each of said LED elements and having substantially rectangular apertures, each of which is associated with a corresponding LED element and each of which allows light from its associated LED element to pass to the image bearing member to illuminate it with a substantially rectangular illumination area; and a plurality of lens means opposed to said apertures, wherein a distance a from a light emitting chip of said LED element and said aperture, a length b of a diagonal line of the aperture, a distance c from the light emitting chip of said LED elements to said lens means and a maximum diameter d of the lens means satisfy:

$$d \geqq bc/a.$$

2. A device according to claim 1, wherein said blocking means has surfaces facing to said LED elements, which surfaces are anti-reflection surfaces.

3. A device according to claim 1, wherein said LED elements are directly held on a print substrate.

4. A device according to claim 1 wherein said blocking means is so arranged that the adjacent illumination areas are partially superimposed.

5. An image forming apparatus comprising:

a movable image bearing member;

a charger for electrically charging said image bearing member;

developing means for developing an electrostatic latent image formed on said image bearing member;

illumination means disposed between said charger and said developing means, for illuminating said image bearing member to remove the electric charge from said image bearing member to prevent deposition of a developer by said developing means in an area exposed to the illumination thereof, said illumination means including:

a plurality of LED elements arranged substantially along a line extending in a direction crossing with a direction of movement of said image bearing member; and light blocking means provided for and corresponding to each of said LED elements and having substantially rectangular apertures, each of which is associated with a corresponding LED element and each of which allows light from its associated LED element to pass to said image bearing member to illuminate it with a substantially rectangular illumination area; and a plurality of lens means opposed to said apertures;

control means for controlling actuation of each of said LED elements, wherein a distance a from a light emitting chip of said LED element and said aperture, a length b of a diagonal line of the aperture, a distance c from the light emitting chip of said LED elements to said lens means, and a miximum diameter d of the lens means satisfy:

$$d \geqq bc/a.$$

6. An apparatus according to claim 5, wherein said blocking means has surfaces facing to said LED elements, which surfaces are anti-reflection surfaces.

7. An apparatus according to claim 5, wherein said LED elements are directly held on a print substrate.

8. An apparatus according to claim 5, wherein said image forming apparatus has a masking or trimming function, and said control means controls said LED elements in accordance with an area designated by the masking or trimming function.

9. An apparatus according to claim 5, further comprising a plurlaity of lens means opposed to said apertures, respectively.

10. An apparatus according to claim 5, wherein said blocking means is so arranged that the adjacent illumination areas are partially superimposed.

11. An illumination device for illuminating an image bearing member, comprising:

a plurality of LED elements arranged substantially along a line extending in use in a direction crossing with a direction of movement of the image bearing member;

light blocking means provided for and corresponding to each of said led elements and having an array of substantially rectangular apertures, each of which is associated with a corresponding LED element and each of which allows light from its associated LED element to pass to the image bearing member;

an array of lens means, opposed to said apertures, respectively, for passing light toward the image bearing member, whereby each of the led elements illuminates said image bearing member with a substantially rectangular illumination area; and limiting means for further limiting the light limited by said light blocking means.

12. A device according to claim 11, wherein said blocking means has surfaces facing said LED elements, which surfaces are anti-reflection surfaces.

13. A device according to claim 11, wherein said LED elements are directly held on a print substrate.

14. A device according to claim 11, wherein said limiting means is disposed between said lens means and said iamge bearing member.

15. A device according to claim 11, wherein said limiting means includes partition members disposed between adjacent lens means of said array of the lens means.

16. An image forming apparatus, comprising:

a movable image bearing member;

a charger for electrically charging said image bearing member;

developing means for developing an electrostatic latent image formed on said image bearing member;

illumination means, disposed between said charger and said developing means, for illuminating said image bearing member to remove the electric charge from said image bearing member to prevent deposition of a developer by said developing means in an area exposed to the illumination thereof, said illumination means including:

a plurality of LED elements arranged substantially along a line extending in a direction crossing with a direction of movement of said image bearing member;

light blocking means provided for and corresponding to each of said LED elements and having an array of substantially rectangular apertures, each of which is associated with a corresponding LED element and each of which allows light from its associated LED element to pass to said image bearing member;

an array of lens means, opposed to said apertures, respectively, for converging light toward the image bearing member, whereby each of the LED elements illuminates said image bearing member with a substantially rectangular illumination area through said lens means limiting means for further limiting the light limited by said light blocking means.

17. An apparatus according to claim 16, wherein said blocking means has surfaces facing said LED elements, which surfaces are anti-reflection surfaces.

18. An apparatus according to claim 16, wherein said LED elements are directly held on a print substrate.

19. A device according to claim 16, wherein said limiting means is disposed between said lens means and said image bearing member.

20. A device according to claim 16, wherein said limiting means includes partition members disposed between adjacent lens means of said array of the lens means.

21. An illumination device for illuminating an image bearing member, comprising:

a plurality of LED elements arranged substantially along a line extending in use in a direction crossing with a direction of movement of the image bearing member; and light blocking means provided for an corresponding to each of said LED elements and having substantially rectangular apertures, each of which is associated to each of said LED elements and each of which allows light from its associated LED element to pass to the image bearing member to illuminate it with a substantially rectangular illumination area, said light blocking means being provided with a rough surface for blocking the light.

22. A device according to claim 21, wherein the light blocking portion is black in color.

23. A device according to claim 22, wherein a surface of said light blocking means opposed to the image bearing member is also black in color.

24. An image forming apparatus capable of forming an image with a selected part erased, comprising:

a movable image bearing member;

charging means for electrically charging the image bearing member;

exposure means for exposing said image bearing member with image exposure light bearing information;

developing means for developing a latent image formed on said image bearing member;

charger erasing means separate from and disposed between said charging means and said developing means for erasing charge of a selected part on the image bearing member to prevent said part from being developed, said charge erasing means including:

an array of light emitting diodes arranged in a line at regular intervals in a direction crossing with a direction of movement of the image bearing member;

light blocking means having a plurality of substantially rectangular apertures of substantially the same configuration and dimension disposed in a line, wherein each of said apertures is associated with a corresponding light emitting diode, said apertures each trimming the light emitted from their associated light emitting diodes in four directions which are parallel with the image bearing member movement or with the arrangement of the light emitting diodes; and wherein areas illuminated by the light passed through adjacent ones of the apertures overlap on said image bearing member; and control means for controlling actuation of the light emitting diodes according to said selected part.

25. An apparatus according to claim 24, wherein said LED diodes are directly held on a print substrate.

26. An apparatus according to claim 24, further comprising lens means disposed in the apertures.

27. An apparatus according to claim 24, wherein said illuminating means extends over substantially the entire width of the image bearing member.

* * * * *

UNITED STATES PATENT AND TRADEMARK OFFICE

CERTIFICATE OF CORRECTION

PATENT NO. : 4,734,734

DATED : March 29, 1988

INVENTOR(S) : HIDEAKI YANO

It is certified that error appears in the above-identified patent and that said Letters Patent is hereby corrected as shown below:

IN THE DRAWINGS

Sheet 9, Figure 19, "μ-CONPUTER" should read --μ-COMPUTER--.

COLUMN 1

Line 15, "a" should be deleted.
Line 54, "are Y." should read --area Y.--.

COLUMN 2

Line 26, "therefore" should read --therefor--.
Line 34, "neighborehood" should read --neighborhood--.

COLUMN 7

Line 45, "show" should read --shown--.
Line 49, "illumiantion" should read --illumination--.

COLUMN 9

Line 13, "conrolled" should read --controlled--.

COLUMN 10

Line 3, "to" should be deleted.
Lines 42-43, "miximum" should read --maximum--.
Line 47, "to" should be deleted.
Line 57, "plurlaity" should read --plurality--.

UNITED STATES PATENT AND TRADEMARK OFFICE

CERTIFICATE OF CORRECTION

PATENT NO. : 4,734,734

DATED : March 29, 1988

INVENTOR(S) : HIDEAKI YANO

It is certified that error appears in the above-identified patent and that said Letters Patent is hereby corrected as shown below:

COLUMN 11

Line 2, "led" should read --LED--.
Line 9, "led" should read --LED--.
Line 21, "iamge" should read --image--.
Line 57, "means" should read --means; and--.

COLUMN 12

Line 11, "an" should read --and--.
Line 21, "portion" should read --means--.
Line 35, "charger" should read --charge--.

Signed and Sealed this

Twenty-eighth Day of March, 1989

*Attest:*

DONALD J. QUIGG

*Attesting Officer*

*Commissioner of Patents and Trademarks*